US007100420B2

(12) United States Patent
Read et al.

(10) Patent No.: US 7,100,420 B2
(45) Date of Patent: Sep. 5, 2006

(54) CIGARETTE MONITORING

(75) Inventors: Graham Albert Read, London (GB); Nigel David Warren, Southampton (GB)

(73) Assignee: British American Tobacco (Investments) Limited), London (GB)

( * ) Notice: Subject to any disclaimer, the term of this patent is extended or adjusted under 35 U.S.C. 154(b) by 191 days.

(21) Appl. No.: 10/477,280

(22) PCT Filed: Jun. 5, 2002

(86) PCT No.: PCT/GB02/02629

§ 371 (c)(1),
(2), (4) Date: Nov. 12, 2003

(87) PCT Pub. No.: WO02/098245

PCT Pub. Date: Dec. 12, 2002

(65) Prior Publication Data

US 2004/0177674 A1 Sep. 16, 2004

(30) Foreign Application Priority Data

Jun. 7, 2001 (GB) ..... 0113868.4
Aug. 14, 2001 (GB) ..... 0119724.3

(51) Int. Cl.
*G01N 7/00* (2006.01)
*A24F 1/10* (2006.01)

(52) U.S. Cl. ..... 73/23.33; 131/330

(58) Field of Classification Search ..... 73/37, 73/38, 23.31, 23.33, 31.04; 131/270, 330
See application file for complete search history.

(56) References Cited

U.S. PATENT DOCUMENTS 2,228,216 A * 1/1941 Morgan ..... 73/23.31
3,056,026 A * 9/1962 Bigelow ..... 378/56
3,204,449 A * 9/1965 Fordyce ..... 73/38
3,476,119 A * 11/1969 Walton ..... 131/330
3,548,840 A * 12/1970 Baumgartner ..... 131/330

(Continued)

FOREIGN PATENT DOCUMENTS

JP 04071477 A * 3/1992

(Continued)

*Primary Examiner*—Hezron Williams
*Assistant Examiner*—John Fitzgerald
(74) *Attorney, Agent, or Firm*—Charles I. Sherman; Middleton Reutlinger

(57) ABSTRACT

A cigarette monitoring device capable of monitoring individual smoking behaviour and particularly smoke deliveries and of communicating this and other information to a remote location and/or the consumer. The device comprises a cigarette monitoring means, fluid-flow pressure drop and smoke density detection means, data transmission means, data receiving and processing means, as well as means to display the processed data. Display means of the invention may display information that is of interest to the smoker and may offer a direct sales service to the consumer.

28 Claims, 2 Drawing Sheets

U.S. PATENT DOCUMENTS

| | | | | | |
|---|---|---|---|---|---|
| 3,548,841 | A | * | 12/1970 | Caughey | 131/330 |
| 4,019,366 | A | * | 4/1977 | Claflin et al. | 73/23.3 |
| 4,138,722 | A | * | 2/1979 | Bonnett | 131/270 |
| 4,140,003 | A | * | 2/1979 | Pillsbury et al. | 73/23.31 |
| 4,171,635 | A | * | 10/1979 | Calleson et al. | 73/38 |
| 4,184,360 | A | * | 1/1980 | Vadnay et al. | 73/28.01 |
| 4,246,913 | A | * | 1/1981 | Ogden et al. | 131/270 |
| 4,365,640 | A | * | 12/1982 | Lorenz et al. | 131/330 |
| 4,400,972 | A | * | 8/1983 | Wiethaup | 73/38 |
| 4,596,134 | A | * | 6/1986 | Weatherly | 73/38 |
| 4,627,448 | A | * | 12/1986 | Kamm et al. | 131/187 |
| 4,858,628 | A | * | 8/1989 | Norman et al. | 131/329 |
| 5,044,380 | A | * | 9/1991 | Crooks et al. | 131/329 |
| 5,117,845 | A | * | 6/1992 | Poulet et al. | 131/330 |
| 5,377,697 | A | * | 1/1995 | Deutsch et al. | 131/330 |
| 5,396,907 | A | * | 3/1995 | Rojas Henao et al. | 131/175 |
| 5,638,833 | A | * | 6/1997 | Bowen et al. | 131/202 |
| 6,796,312 | B1 | * | 9/2004 | Eichel | 131/334 |
| 6,814,083 | B1 | * | 11/2004 | Likness et al. | 131/330 |
| 2003/0137312 | A1 | * | 7/2003 | Cerati et al. | 324/633 |
| 2004/0031497 | A1 | * | 2/2004 | Likness et al. | 131/270 |
| 2006/0130860 | A1 | * | 6/2006 | Cholet | 131/330 |

FOREIGN PATENT DOCUMENTS

| | | | | |
|---|---|---|---|---|
| JP | 09107943 | A | * | 4/1997 |
| WO | WO 8806836 | A | * | 9/1988 |

* cited by examiner

CIGARETTE MONITORING

CROSS REFERENCE TO PRIOR APPLICATION

This application claims is a national stage filing (35 U.S.C. 371) of PCT/GB02/02629, which claims priority to and benefit of Great Britain Patent Application No. 0113868.4, filed on Jun. 7, 2001, currently pending, and claims priority to and benefit of Great Britain Patent Application No. 0119724.3, filed Aug. 14, 2001, currently pending.

BACKGROUND OF THE INVENTION

The subject invention relates to cigarette monitoring means operable to monitor aspects of cigarette mainstream smoke whilst a cigarette is the subject of human, as opposed to machine, smoking.

Known in the tobacco industry are cigarette monitors comprising a cigarette holder by which may be mounted a cigarette at the mouth end of the cigarette. In unit with the holder is a mouthpiece by means of which a cigarette mounted in the holder can be smoked by a human smoker, the mouthpiece being in fluid-flow communication with the mouth end of such cigarette. Betwixt the mouth end of such cigarette and the mouthpiece are disposed elements of fluid-flow pressure drop detection means and smoke density detection means. Such known cigarette monitors further comprise a data processing unit, the cigarette holder being connected to this unit by tubes of the fluid-flow detection means and electrical leads of the smoke density detection means. Such devices, however, do not provide actual smoking delivery values, merely a means of recording a real-time puff delivery profile.

It is an object of the subject invention to provide an improved cigarette monitoring means.

SUMMARY OF THE INVENTION

According to a first aspect thereof the subject invention provides cigarette monitoring means comprising:

cigarette mounting means by which a cigarette can be mounted at the mouth end thereof, said mounting means comprising a mouthpiece, which mouthpiece is, when said mounting means mounts a cigarette, in fluid-flow communication with the mouth end of the cigarette;

in unit with said mounting means fluid-flow pressure drop detection means and smoke density detection means;

at the location of said mounting means data transmission means operable to transmit data derived from said pressure drop detection means and said smoke density detection means;

data receiving and processing means operable to receive and process data transmitted by said transmission means, the processing effected by said processing means comprising a calculation of a delivery value of particulate phase smoke components from a cigarette when mounted by said mounting means and being smoked via said mouthpiece; and display means operable to display processed data from said receiving and processing means.

Preferably the data transmission means transmits data by conductorless electromagnetic wave means.

By preference, the data transmission means is in unit with the cigarette mounting means.

Advantageously, the display means is in unit with the data receiving and processing means.

The cigarette monitoring means may comprise a second transmission means, which second transmission means is operable to transmit processed data output from data processing effected by the data receiving and processing means. When the cigarette monitoring means comprises such a second transmission means, the cigarette monitoring means comprises also receiving means and associated display means at the location of the cigarette mounting means, this receiving means being operable to receive processed data transmissions, which may be conductorless processed data transmission means or not, from the second transmission means, and the associated display means being operable to display the processed data.

Advantageously, when the cigarette monitoring means comprises an aforesaid second transmission means, the display means at the location of the cigarette mounting means is additional to a display means associated with the data receiving and processing means. The display means at the location of the cigarette mounting means is suitably in unit with the associated receiving means, in which case both are suitably in unit with the mounting means.

If the cigarette monitoring means comprises an aforesaid second transmission means, the cigarette monitoring means may also comprise data input means, which data input means is operable to receive data, sound and/or graphic data, and to feed the inputted data to the second transmission means. If the inputted data are sound derived data, the display means at the location of the mounting means must be operable to reproduce sound.

Preferably the second transmission means is operable to transmit processed data output by conductorless electromagnetic wave means. Alternatively the transmission may be conducted by cable or wire transmission, for example, telephone line.

According to a second aspect of the subject invention there is provided cigarette monitoring means comprising:

cigarette mounting means by which a cigarette can be mounted at the mouth end thereof, said mounting means comprising a mouthpiece, which mouthpiece is, when said mounting means mounts a cigarette, in fluid-flow communication with the mouth end of the cigarette;

in unit with said mounting means fluid-flow pressure drop detection means and smoke density detection means;

at the location of said mounting means processing means operable to process data from said pressure drop detection means and said smoke density detection means, the processing effected by said processing means comprising a calculation of a delivery value of particulate phase smoke components from a cigarette when mounted by said mounting means and being smoked via said mouthpiece;

at the location of said mounting means data transmission means operable to transmit processed output data from said processing means; data receiving means operable to receive processed output data from said transmission means; and display means operable to display processed data from said receiving means.

Preferably the data transmission means transmits data by conductorless electromagnetic wave means.

By preference, in cigarette monitoring means according to the second aspect of the subject invention the processing means is in unit with the cigarette mounting means. By preference, the data transmission means is in unit with the mounting means.

By preference, in cigarette monitoring means in accordance with the second aspect of the subject invention the display means is in unit with the data receiving means.

Cigarette monitoring means according to the second aspect of the subject invention may comprise, at the location of the processing means, second display means, which second display means is operable to display processed data from the processing means.

Monitoring means according to the second aspect of the invention may comprise second transmission means, second data receiving means and second, associated display means at the location of the cigarette mounting means and data input means, the input means being operable to receive data, sound and/or graphic data, and to feed the inputted data to the second transmission means for conductorless transmission thereof to the second receiving means, the inputted data then being displayable by the second display means.

Preferably the mouthpiece is in gas-flow communication with the mouth end of the cigarette.

Advantageously, and in addition to advising the consumer of their real-time smoking behaviour, in either aspect of the invention, the associated display means or second display means associated with the cigarette monitoring device may display information that is of interest to the smoker, for example, alternative products of the smoking article manufacturer that may be of interest to the consumer, and may offer in addition or alternatively, means to provide a direct sales service to the smoker of the same or alternative products, or indeed other products or services not being smoking articles or related thereto.

As well be appreciated by a man skilled in the art, the monitoring device will be operable with any smoking article, such as cigar, or any other smoking article device that produces particulate material that could be assessed by the smoke density detection means and termed 'smoke'.

BRIEF DESCRIPTION OF THE DRAWINGS

In order that the subject invention may be clearly understood and readily carried into effect, reference will now be made, by way of example, to the accompanying drawings, in which.

DESCRIPTION OF THE PREFERRED EMBODIMENTS

Figure 1:
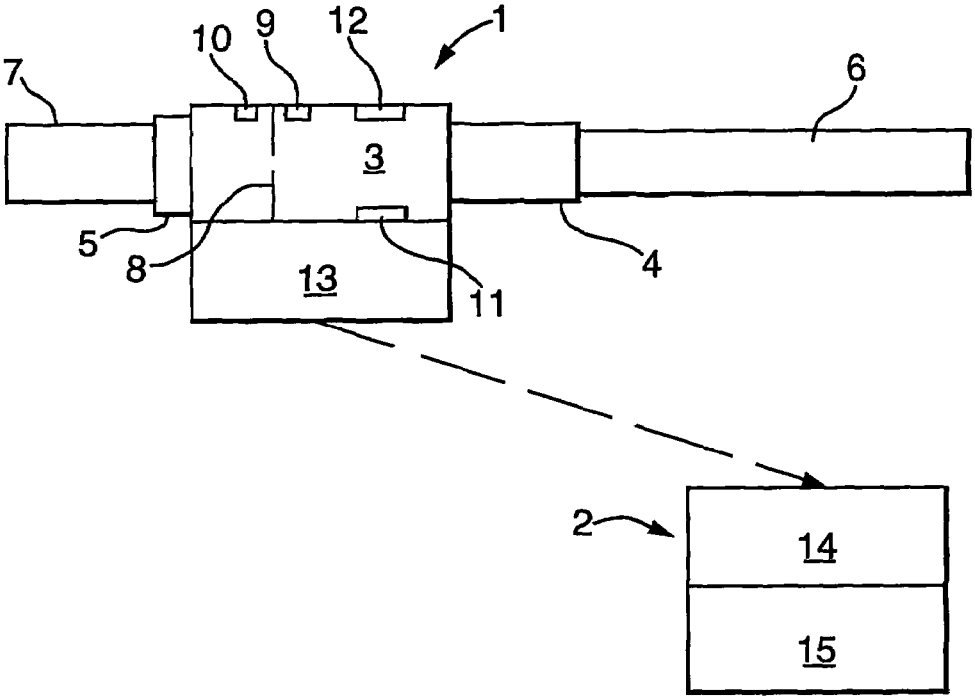
FIG. 1 shows a block diagram depiction of a first cigarette monitoring apparatus.

The cigarette monitoring apparatus of FIG. 1 comprises a cigarette mounting assembly 1 and a monitoring assembly 2, which assembly 2 will, in use of the apparatus of FIG. 1, be located remote the cigarette mounting assembly 1, at a distance of tens or hundreds of yards, for example. The distance may even be one that is measured in miles.

The cigarette mounting assembly 1 comprises a housing 3, at one end of which is secured a hollow sleeve 4 and at the opposite end of which is secured a mouthpiece holder 5. A cigarette (6) can be mounted in the sleeve 4 and a disposable mouthpiece (7) can be mounted in the holder 5. With such a cigarette and such a mouthpiece mounted of the housing 3, the mouthpiece is in fluid-flow communication with the cigarette via the hollow interior of the housing 3, such that the cigarette may be smoked via the mouthpiece.

Mounted within the housing 3 is an orifice plate 8 and, one to each side of the orifice plate 8, are mounted pressure detectors 9 and 10. Also mounted within the housing 3 are a light emitter 11 and, opposed to the transmitter 11, a light receiver 12.

In unit with the cigarette mounting assembly 1, i.e. fixedly or detachably secured thereto, is a data transmission module 13. The module 13 is operable to receive pressure signals from the pressure detectors 9 and 10 and a light signal from the light receiver 12, and to transmit to the monitoring assembly 2 data derived from these pressure and light related signals. This transmission is by conductorless, i.e. "wireless", electromagnetic wave means; it can be a radio frequency transmission, for example.

The monitoring assembly 2 comprises a data receiving and processing module 14 and, in unit therewith, a display module 15. The module 14 is operable to receive aforesaid data transmitted by the module 13 and to process this data. The processing of the data produces, or includes, a real-time value of the delivery of the particulate phase components of the mainstream smoke (demotically known as "tar") of a cigarette (6) which is mounted in the sleeve 4 of the housing 3 and is being smoked via a mouthpiece (7) mounted in the holder 5 of the housing 3.

Processed data, such, for example, as the real-time values of "tar", can be displayed by the display module 15, on a display screen thereof, for example.

As will be readily appreciated by those possessing routine skill and knowledge in the art, from the pressure difference across the orifice plate 8 within the housing 3, which pressure difference can be derived from the pressure signals from the detectors 9 and 10, there may be calculated instantaneous values of flow rate of the mainstream smoke from a cigarette (6) mounted in the sleeve 4. Similarly, the obnubilation effected by the mainstream smoke on the light emitted by the light-emitter 11, which obnubilation is registered by way of the light receiver 12, provides a means of determining the instantaneous density values of the smoke, i.e. the concentration therein of the particulate phase components. By combining flow rate and density values integrated over time, it is readily possible to provide delivery values of "tar" on a per puff basis.

In that the data received by the module 14 is transmitted from the module 13 by conductorless electromagnetic wave means, the unit comprised of the cigarette mounting assembly 1 and the transmission module 13 is unencumbered by tubes (associated with pressure detectors 9, 10) and wires (associated with light receiver 12) extending therefrom. Of course, if appropriate to particular circumstances the conductorless transmission can be first received by intermediate receiving means (not shown), the data then being transmitted to the data receiving and processing module 14 by way of conductor means (also not shown).

Figure 2:
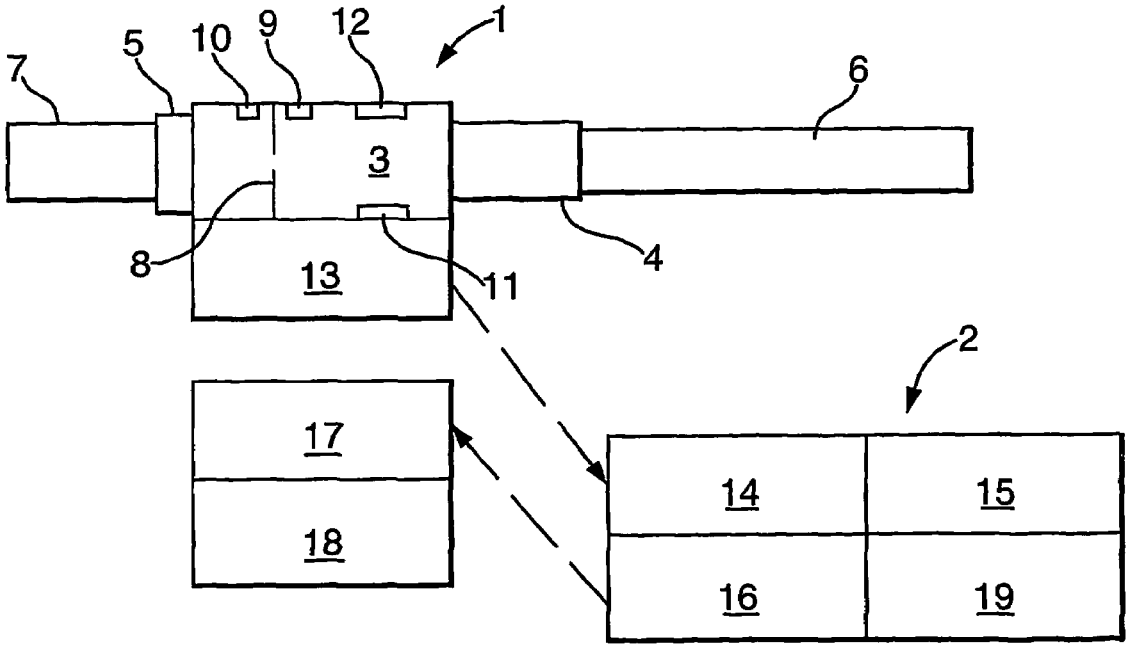
FIG. 2 shows a block diagram depiction of a second cigarette monitoring apparatus, being a modification of the apparatus of FIG. 1.

The cigarette monitoring apparatus depicted in FIG. 2 is the apparatus of FIG. 1 modified by the addition of further functional modules as now to be described. Parts in FIG. 2 which correspond to parts in FIG. 1 have been assigned the same reference numerals as those assigned for those parts in FIG. 1.

The functional modules comprised in the apparatus of FIG. 2 which do not form part of the FIG. 1 apparatus are as follows:

(i) a second transmission module 16;

(ii) a second receiving module 17;

(iii) a second display module 18; and (iv) a data input module 19.

The second transmission module 16 is operable to transmit, by conductorless electromagnetic wave means, processed data output from the receiving and processing module 14. This conductorless transmission is preferably emitted directly from the module 16. However, if appropriate to particular circumstances, the conductorless transmission can emanate from the intermediate transmission means (not shown), the processed data being transmitted from the module 16 to the intermediate transmission means by way of conductor means, electrical conductor means, for example, (also not shown).

As is indicated in the FIG. 2 block diagram, the second transmission module 16 forms an in unit component of the monitoring assembly 2.

The second receiving module 17, which is situated at or near to the location of the cigarette mounting assembly 1, is operable to receive conductorless transmissions from the second transmission module 16.

The second display module 18 is operable to display processed data received by the second receiving module 17 from the second transmission module 16.

Preferably, the second display module 18 is in unit with the second receiving modules 17, and suitably these modules 17, 18 are both in unit with components of the cigarette mounting assembly 1.

In the processor module 14 data derived from the pressure sensors 9, 10 and from the light receiver 12 are processed as per the processing effected by the processing module 14 of the FIG. 1 apparatus.

The data input module 19 is operable to receive inputted data, sound and/or graphic data, and to feed the inputted data to the second transmission module 16. Thus an operator at the location of assembly 2 can communicate with a subject who is smoking or who has just smoked a cigarette (6) via a mouthpiece (7). If, of course, inputted data takes the form of sound or sound derived data, the second display module 18 must be operable to reproduce sound.

The display of the second display module may offer alternative products capable of producing similar or lower smoke component deliveries. Alternatively, or in addition thereto, the display may offer a direct sales service to the consumer, enabling purchasing of goods (smoking article goods or not) directly. A business transaction may thereby take place using the invention according to either aspect of the invention.

The data input module 19 forms an in unit component of assembly 2.

The assembly 1, including modules 17, 18, may be incorporated in a mobile phone, i.e. a mobile telephone hand piece, (this not being shown), in which case the transmission module 13 may be the transmission means of the phone or share components therewith, the receiving module 17 may be the receiving means of the phone or share components therewith and the display module 18 may be a display means of the phone or share components therewith.

The assembly 2 comprising modules 14–16 and 19 may be incorporated in or form part of a mobile phone (this not being shown), in which case the receiving module 14 may be the receiving means of the phone or share components therewith, the display module 15 may be a display means of the phone or share components therewith, the transmission module 16 may be the transmission means of the phone or share components therewith and the input module 19 is input means of the phone or shares components therewith. As will be understood, a function of the input means of the phone is to register telephone number dialling by a user of the phone.

Figure 3:
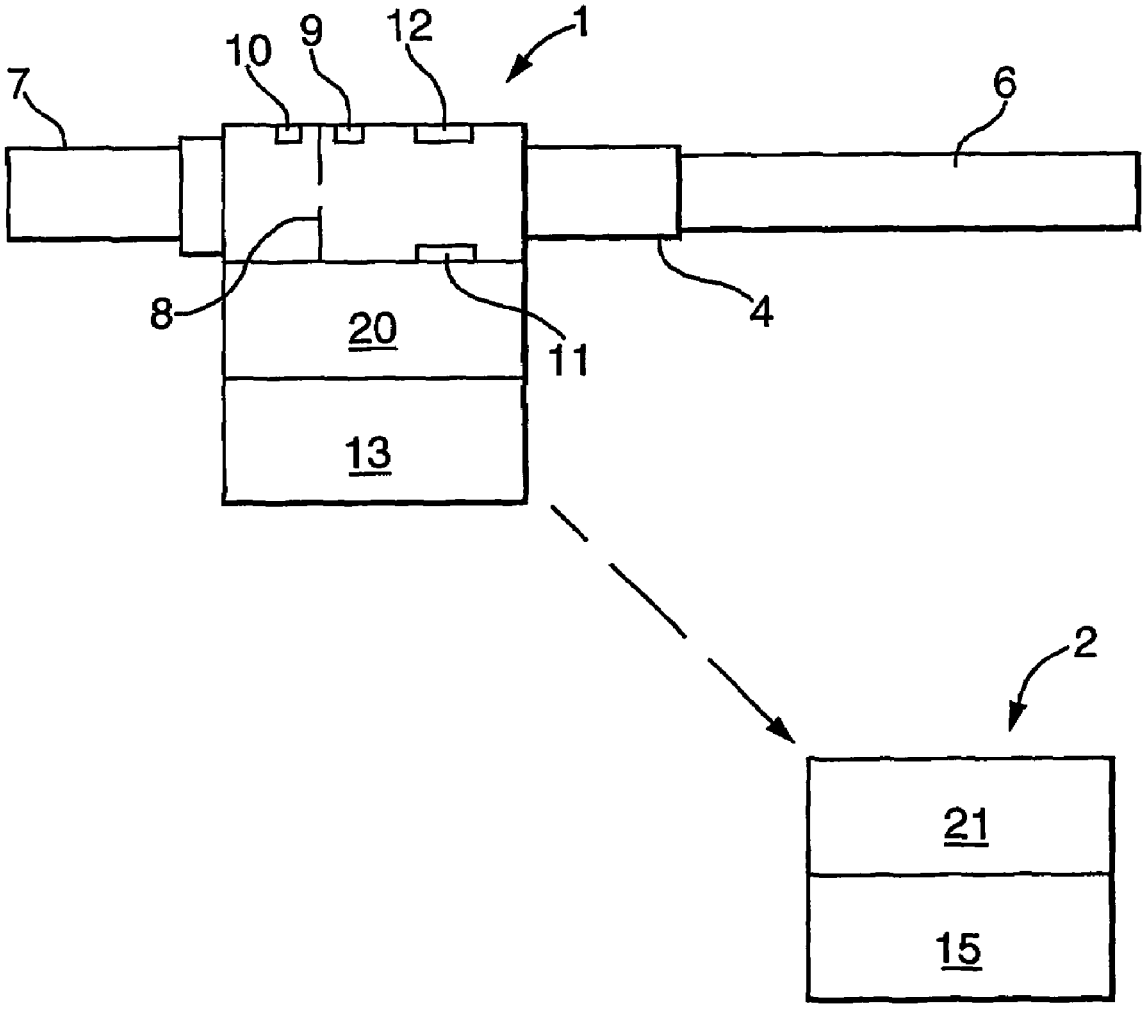
FIG. 3 shows a block diagram depiction of a third cigarette monitoring apparatus, being another modification of the apparatus of FIG. 1.

The cigarette monitoring apparatus of FIG. 3 is a variant of the apparatus depicted in FIG. 1. Thus common parts have been assigned common reference numerals.

Assembly 2 of the FIG. 3 apparatus does not comprise as a component thereof a receiving and processing module as per module 14 of the FIG. 2 apparatus, but rather comprises a receiving module 21. As indicated in FIG. 3, the receiving module 21 is in unit with a display module 15. The processing function in the FIG. 3 apparatus takes place in a processing module 20 which is an in unit component of the cigarette mounting assembly 1. Also being an in unit component of the assembly 1 is a transmission module 13.

Thus in operation of the FIG. 3 apparatus when a cigarette (6) is being smoked via a mouthpiece (7), data derived from the pressure sensors 9, 10 and the light receiver 12 is processed by the processing module 20 in a manner as per that described hereinabove in respect of the processing module 14 of the apparatus of FIG. 1. Processed data output of the processing module 20 is transmitted from the transmission module 13 in conductorless fashion and is received by the receiving module 21 and then displayed by the display module 15.

As will be readily understood by versed in the art addressees, just as the FIG. 2 apparatus has incorporated therein, vis-à-vis the apparatus of FIG. 1, modules 16–19, these same modules 16–19 can be incorporated, in the same manner and to the same functional effect, in the apparatus depicted in FIG. 3.

Furthermore, if the modules 16–19 are so incorporated in the apparatus of FIG. 3, the assembly 1 of that apparatus, including with modules 17 and 18, may be incorporated in a mobile phone. Likewise, assembly 2, including modules 16 and 19, may be incorporated in a mobile phone.

The invention claimed is:

1. A cigarette monitoring means capable of monitoring smoking behaviour of an individual smoker comprising:

cigarette mounting means by which a cigarette can be mounted at the mouth end thereof, said mounting means comprising a mouthpiece, which mouthpiece is, when said mounting means mounts a cigarette, in fluid-flow communication with the mouth end of the cigarette;

in unit with said mounting means fluid-flow pressure drop detection means and smoke density detection means;

at the locations of said mounting means data transmission means operable to transmit data derived from said pressure drop detection means and said smoke density detection means;

data receiving and processing means operable to receive and process data transmitted by said transmission means, the processing effected by said processing means comprising a calculation of a delivery value of particulate phase smoke components from a cigarette when mounted by said mounting means and being smoked via said mouthpiece;

display means operable to display processed data from said receiving and processing means; and a second transmission means operable to transmit processed data input from data processing effected by said data receiving and processing means.

2. A cigarette monitoring means according to claim 1, wherein said data transmission means transmits data by conductorless electromagnetic wave means.

3. A cigarette monitoring means according to claim 1, wherein said data transmission means is in unit with said cigarette mounting means.

4. A cigarette monitoring means according to claim 1, wherein said display means is in unit with said data receiving and processing means.

5. A cigarette monitoring means according to claim 1, wherein said second transmission means is operable to transmit processed data output by conductorless electromagnetic wave means.

6. A cigarette monitoring means according to claim 1, wherein said cigarette monitoring means comprises receiving means and associated display means at the location of said cigarette mounting means.

7. A cigarette monitoring means according to claim 6, wherein said receiving means is operable to receive conductorless processed data transmissions from said second transmission means.

8. A cigarette monitoring means according to claim 6, wherein said receiving means is operable to receive conducted processed data transmissions from said second transmission means.

9. A cigarette monitoring means according to claim 6, wherein said associated display means is operable to display said processed data.

10. A cigarette monitoring means according to claim 6, wherein said associated display means at said location of said cigarette mounting means is additional to said display means associated with said data receiving and processing means.

11. A cigarette monitoring means according to claim 6, wherein said associated display means displays to the smoker other information that is information unrelated to the delivery value of the cigarette being smokable therein.

12. A cigarette monitoring means according to claim 6, wherein said associated display means offers a means to provide a direct sales service to the smoker of the same or alternative products, or other products or services not being smoking articles or related thereto.

13. A cigarette monitoring means according to claim 6, wherein said associated display means at said location of said cigarette mounting means is in unit with said associated receiving means.

14. A cigarette monitoring means according to claim 13, wherein said associated display means and said receiving means are in unit with said mounting means.

15. A cigarette monitoring means according to claim 1, wherein said cigarette monitoring means comprises data input means.

16. A cigarette monitoring means according to claim 15, wherein said data input means is operable to receive data, sound and/or graphic data.

17. A cigarette monitoring means according to claim 16, wherein said data input means is operable to feed the inputted data to said second transmission means.

18. A cigarette monitoring means according to claim 16, wherein said associated display means at said location of said mounting means is operable to reproduce sound.

19. A cigarette monitoring means capable of monitoring smoking behaviour of an individual smoker comprising:

cigarette mounting means by which a cigarette can be mounted at the mouth end thereof, said mounting means comprising a mouthpiece, which mouthpiece is, when said mounting means mounts a cigarette, in fluid-flow communication with the end of the cigarette;

in unit with said mounting means fluid-flow pressure drop detection means and smoke density detection means;

at the location of said mounting means processing means operable to process data from said pressure drop detection means and said smoke density detection means, the processing effected by said processing means comprising a calculation of a delivery value of particulate phase smoke components from a cigarette when mounted by said mounting means and being smoked via said mouthpiece;

at the location of said mounting means data transmission means operable to transmit processed output data from said processing means;

data receiving means operable to receive processed output data from said transmission means;

display means operable to display processed data from said receiving means; and at the location of said processing means, second display means, which said second display means is operable to display processed data from said processing means.

20. A cigarette monitoring means according to claim 19, wherein said data transmission means transmits said processed output data by conductorless electromagnetic wave means.

21. A cigarette monitoring means according to claim 19, wherein said processing means is in unit with said cigarette mounting means.

22. A cigarette monitoring means according to claim 19, wherein said display means is in unit with said data receiving means.

23. A cigarette monitoring means according to claim 19, wherein said mouthpiece is in gas-flow communication with the mouth end of said cigarette.

24. A cigarette monitoring means capable of monitoring smoking behaviour of an individual smoker comprising:

cigarette mounting means by which a cigarette can be mounted at the mouth end thereof, said mounting means comprising a mouthpiece, which mouthpiece is, when said mounting means mounts a cigarette, in fluid-flow communication with the end of the cigarette;

in unit with said mounting means fluid-flow pressure drop detection means and smoke density detection means;

at the location of said mounting means processing means operable to process data from said pressure drop detection means and said smoke density detection means, the processing effected by said processing means comprising a calculation of a delivery value of particulate phase smoke components from a cigarette when mounted by said mounting means and being smoked via said mouthpiece;

at the location of said mounting means data transmission means operable to transmit processed output data from said processing means;

data receiving means operable to receive processed output data from said transmission means;

display means operable to display processed data from said receiving means; and, wherein said cigarette monitoring means further comprises second transmission means, second data receiving means and second, associated display means at the location of said cigarette mounting means, and data input means.

25. A cigarette monitoring means according to claim 24, wherein said second display means displays to the smoker other information that is information unrelated to the delivery value of the cigarette being smokable therein.

26. A cigarette monitoring means according to claim 24, wherein said second display means offers a means to provide a direct sales service to the smoker of the same or alternative products, or other products or services not being smoking articles or related thereto.

27. A cigarette monitoring means according to claim 24, wherein said data input means is operable to receive data, sound and/or graphic data, and to feed the inputted data to said second transmission means for transmission thereof to said second receiving means, the inputted data then being displayable by said second display means.

28. A cigarette monitoring means according to claim 27, wherein said transmission of said inputted data is by conductorless electromagnetic wave means.

* * * * *